United States Patent [19]

Makino

[11] Patent Number: 4,704,662

[45] Date of Patent: Nov. 3, 1987

[54] LIGHTING DEVICE FOR AN ELEVATOR

[75] Inventor: Katsumi Makino, Inazawa, Japan

[73] Assignee: Mitsubishi Denki Kabushiki Kaisha, Japan

[21] Appl. No.: 883,507

[22] Filed: Jul. 8, 1986

[30] Foreign Application Priority Data

Jul. 9, 1985 [JP] Japan ..... 60-104434[U]
Jul. 9, 1985 [JP] Japan ..... 60-104435[U]

[51] Int. Cl.[4] ..... F21S 1/47; F21V 21/00

[52] U.S. Cl. ..... 362/147; 362/148; 362/150; 362/293; 362/301; 362/343

[58] Field of Search ..... 362/148, 147, 150, 153, 362/293, 297, 301, 346, 355, 341, 343; 350/103, 162.18, 162.2, 162.23, 601; 52/28.39

[56] References Cited

U.S. PATENT DOCUMENTS

| | | | |
|---|---|---|---|
| 668,446 | 2/1901 | Hirsch | 362/148 |
| 2,398,507 | 4/1946 | Rolph | 362/148 |
| 3,585,121 | 6/1971 | Franks et al. | 350/162.2 X |
| 4,164,011 | 8/1979 | Sherwood | 362/330 X |
| 4,425,603 | 1/1984 | Courson | 362/346 X |

FOREIGN PATENT DOCUMENTS 59-120778 8/1984 Japan .

OTHER PUBLICATIONS

Brochure entitled, "Spectra Star".

*Primary Examiner*—Larry Jones
*Attorney, Agent, or Firm*—Leydig, Voit & Mayer

[57] ABSTRACT

A lighting device for an elevator car having walls including a plurality of light sources for emitting light, and a reflection panel adapted to reflect light from the light sources. The reflection panel comprises a metal mirror decorative panel in the form of a spectral resolution reflecting panel having a reflecting diffraction grating which is composed of a plurality of fine mirror reflection surfaces and a plurality of fine frosted surfaces. The light emitted from the light sources is spectrally resolved into spectral light of excellent coloring by the light diffracting action of the reflecting diffraction grating on the spectral resolution reflecting panel so that the illumination of the elevator car interior is greatly improved in terms of luminance and hue thereof.

9 Claims, 21 Drawing Figures

LIGHTING DEVICE FOR AN ELEVATOR

BACKGROUND OF THE INVENTION

1. Field of the Invention

The present invention relates to a lighting device for an elevator, and more particularly, to an improvement in such a lighting device adapted to be installed in an elevator car.

2. Description of the Prior Art

In general, passengers in an elevator car often feel uneasy or stifled due to the close quarters of the car which is in fact a narrow and closed chamber. In particular, such uneasy feelings will be amplified by the discomfort of being in an elevator installed in one of the super-multistoried buildings, or when one is in an elevator travelling for a relatively long duration, or of being in an elevator car full of passengers. It is, therefore, highly desirable to improve such situations.

On the ceiling of an elevator car which has the greatest influence on the closeness of the car, however, a simple lighting device with monotonous lighting effects alone has hitherto been installed.

The construction of such a conventional lighting device will now be described with reference to FIG. 16. An elevator car 1 has a ceiling panel 2 to which a reflection panel 3 formed of metal having a mirror on the surface of the side facing the car interior is attached. A plurality of light sources 4 such as, for example, small electric lamps, fluorescent lamps or the like are mounted on the reflection panel 3 at locations uniformly distributed thereover so that a part of the light emitted from the respective light sources 4 are reflected by the reflection panel 3 to merge with the remaining portion of the light which directly emit from the light sources 4 into the interior of the car 1 so as to inhance the luminance therein. FIG. 17 illustrates the details in cross section of an example of the light source 4 in the form of a small electric lamp mounted on the reflection panel 3.

Accordingly, when passengers in the elevator car 1 look at the conventional lighting device on the ceiling panel 2 in the car 1, they can see the interior of the car 1 reflected in the mirror surface of the reflection panel 3 and the light sources 4 in the form of dispersed small electric lamps also reflected in a dispersed pattern in the reflection panel 3 as illustrated by broken line 4*a* in FIG. 16. In this case, the light intensity of the light sources 4 is generally determined such that a predetermined luminance can be obtained in the car 1. In other words, the light intensity of the light sources 4 is actually determined from a practical point of view such that passengers in the elevator car 1 can visually discern objects therein.

With the conventional lighting device for an elevator car as constructed in the above manner, the plurality of light sources 4 such as small electric lamps are arranged in a dispersed pattern, and the light beams emitted from the respective light sources 4 are reflected by the reflection panel 3 which is formed of metal and the inner surface of which has a mirror or hairline finish. In addition, the light from the light sources 4, being white light with no change in color, is not appealing to passenger's eyes. Under these circumstances, it is desirable to develop a lighting device which can produce an illumination with color variations.

In addition, in the event that such light sources 4 as electric incandescent lamps employing filaments are used, the light sources are point light sources which have the respective filaments therein and which are narrow in their light-emitting areas. Likewise, imaginary light sources reflected in the metal reflection panel 3, being also point light sources, have narrow light-emitting areas, respectively. As a result, for the purpose of enabling the entire area of the car ceiling to achieve an effective illumination, it is necessary to employ a great number of electric lamps which are to be arranged in a dispersed pattern over the whole ceiling surface. This results in the problem of high production costs.

SUMMARY OF THE INVENTION

The present invention is intended to obviate the above-mentioned problems of the prior art, and has for its object the provision of an improved lighting device for an elevator which is capable of greatly reducing the uneasy or discomfortable feelings on the part of the passengers in an elevator car, and which can provide variously colored attractive illumination in the elevator car, and which is simple in construction and hence low in production costs.

In order to achieve the above object, according to the present invention, there is provided a lighting device for an elevator which comprises: a plurality of light sources for emitting light; and a reflection panel adapted to reflect the light from the light sources toward the interior of an elevator car, the reflection panel comprising a spectral resolution reflecting panel having a reflecting diffraction grating which acts to spectrally resolve the light from the light sources into spectral light.

In one embodiment, the reflection panel is mounted on the ceiling of the elevator car and has a plurality of apertures formed therethrough, the light sources being mounted on the reflection panel in a manner such that the light sources project through the apertures toward the interior of the car.

It is preferred that a half mirror filter be disposed downwardly away from the reflection panel with a mirror surface formed at its one side facing the reflection panel so that the light from the light sources are reflected between and by the reflection panel and the half mirror filter.

In another embodiment, similar reflection panels are arranged on the ceiling and the side walls of the elevator car.

Preferably, the reflection panel has a reflecting surface which is composed of a plurality of mirror reflection surfaces each of a small area and a plurality of frosted surfaces each of a small area, the mirror reflection surfaces and the frosted surfaces being arranged in a predetermined pattern.

In a preferred embodiment, the reflecting surface of the reflection panel comprises a reflecting diffraction grating having a multitude of fine linear mirror reflection surfaces and a multitude of fine areal frosted surfaces alternately arranged with each other.

In a further embodiment, the reflecting surface of the reflection panel comprises a reflecting diffraction grating having a multitude of small mirror reflection surfaces disposed at predetermined intervals in a dispersed manner, and a multitude of frosted surfaces respectively disposed between adjacent mirror reflection surfaces.

In a still further embodiment, the mirror reflection surfaces of the reflection panel are raised from the frosted surfaces of the reflection panel.

Preferably, the mirror reflection surfaces and the frosted surfaces of the reflection panel are alternately arranged at a pitch ranging from a few microns to several tens of microns.

The above and other objects, features and advantages of the present invention will become apparent from the following detailed description of a few presently preferred embodiments of the invention when taken in conjunction with the accompanying drawings.

BREIF DESCRIPTION OF THE DRAWINGS

FIG. 1 is a perspective view showing an internal structure of an elevator equipped with a lighting device which is constructed in accordance with one embodiment of the present invention;

FIG. 2*a* is a detailed cross sectional view showing, on an enlarged scale, a part of the lighting device of FIG. 1 encircled by the dashed line B;

FIG. 3*a* is a perspective view showing a part of a spectral resolution reflecting panel in accordance with the present invention;

FIG. 3*b* is a perspective view showing spectrally resolved light formed on the spectral resolution reflecting panel of FIG. 3*a;*

FIG. 4*a* is a view similar to FIG. 3*a,* showing a part of a modified form of a spectral resolution reflecting panel in accordance with the present invention;

FIG. 4*b* is a view similar to FIG. 3*b,* showing spectrally resolved light formed on the spectral resolution reflecting panel of FIG. 4*a;*

FIG. 4*c* is a view similar to FIG. 3*a,* showing a part of a further modified form of a spectral resolution reflecting panel in accordance with the present invention;

FIG. 4*d* is a view similar to FIG. 3*b,* showing spectrally resolved light formed on the spectral resolution reflecting panel of FIG. 4*c;*

DESCRIPTION OF THE PREFERRED EMBODIMENTS

Now, the present invention will be described in detail with reference to several presently preferred embodiments thereof illustrated in FIGS. 1 through 15 of the accompanying drawings.

Figure 1:
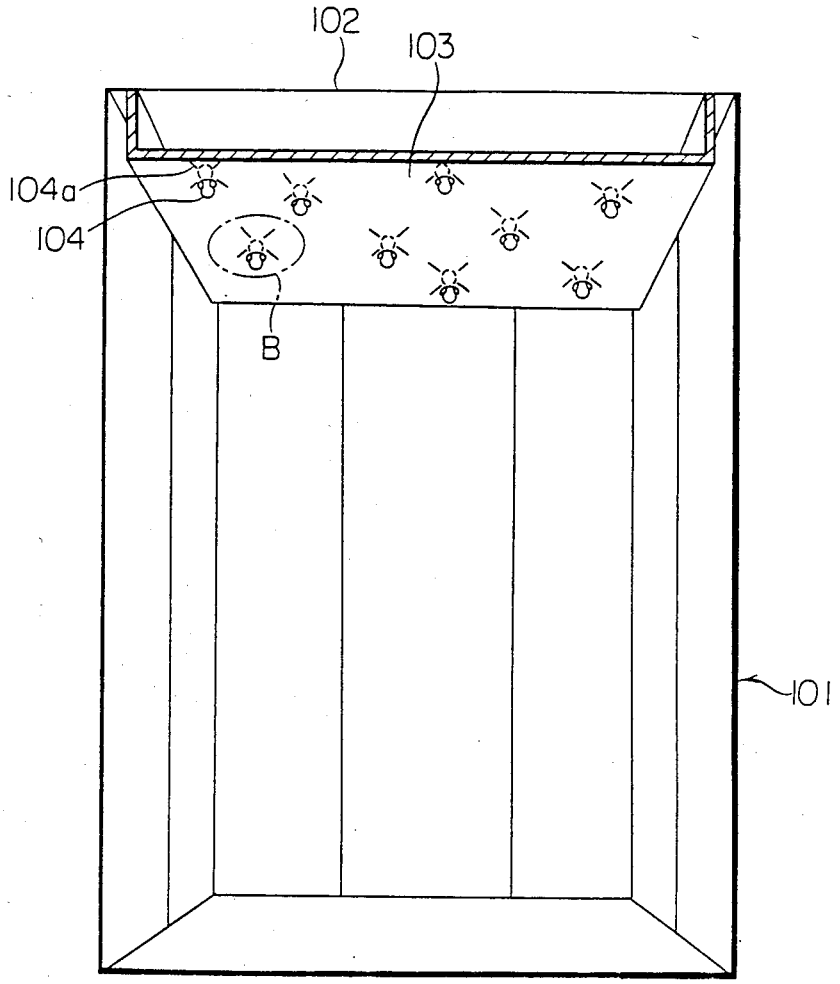

FIG. 1 shows an internal structure of an elevator provided with a lighting device constructed in accordance with a first embodiment of the present invention. In FIG. 1, there is shown an elevator car 101 which includes a ceiling panel 102, and a spectral resolution reflecting panel 103 which is formed of metal and which is mounted on the ceiling panel 102. The spectral resolution reflecting panel 103 has a mirror surface with a reflecting diffraction grating on the one side facing the interior of the car 101. Mounted on the spectral resolution reflecting panel 103 are a plurality of light sources 104 such as, for example, small electric lamps which are adapted to emit complex light. Thus, a part of the complex light emitted from the light sources 104 reaches the spectral resolution reflecting panel 103 and is diffracted by the reflecting diffraction grating on the surface of the spectral resolution reflecting panel 103 to form spectral light 104*a* which is then reflected on the mirror surface of the spectral resolution reflecting panel 103.

Figure 2:
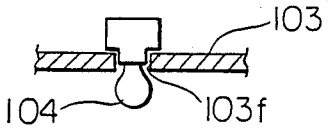

In this manner, a part of the light from the light sources 104 reaching the spectral resolution reflecting panel 103 is spectrally resolved and reflected by the spectral resolution reflecting panel 103 and then merges with the remaining portion of the light directly issued from the light sources 104 so as to improve the luminance and illumination effects in the elevator car 101. FIG. 2 shows the details in cross section of an exemplary one of the light sources in the form of small electric lamps mounted on the spectral resolution reflecting panel 103. As illustrated in FIG. 2, the reflecting panel 103 has a plurality of apertures 103*f* formed therethrough, the electric lamps 104 being mounted on the reflecting panel 103 in a manner such that the electric lamps project through the apertures 103*f* toward the interior of the car 101.

Figure 3A:
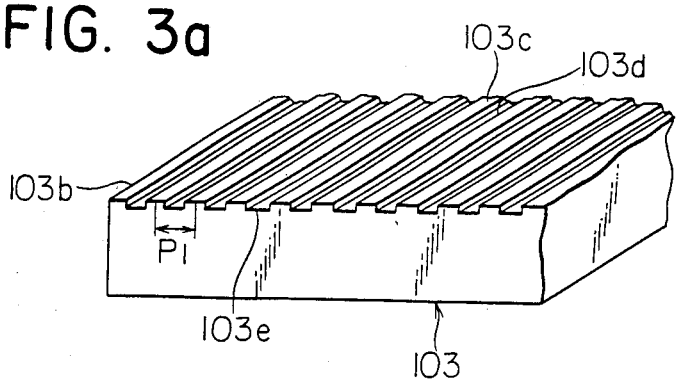

Here, the spectral resolution reflecting panel 103 will be described in detail with particular reference to FIGS. 3*a* and 3*b*. The spectral resolution reflecting panel 103 as illustrated in FIG. 3*a* functions to spectrally resolve complex light by utilization of a light-reflecting diffraction phenomenon. To this end, for example, the surface of a stainless plate 103*b* is polished to form a mirror surface on which is provided a reflecting diffraction grating 103*e* in the form of a fine striped pattern composed of convex stainless mirror surfaces 103*c* capable of mirror reflection and concave stainless mat or frosted surfaces 103*d* incapable of mirror reflection, the mirror surfaces 103*c* and the mat surfaces 103*d* being alternately arranged in parallel with each other at a pitch P1 ranging from a few microns to several tens of microns. When white light formed of complex light, radiated from the whie point light sources 104 disposed near the surface of the spectral resolution reflecting panel 103, reaches the spectral resolution reflecting panel 103, the white light is reflected and diffracted by the reflecting diffraction grating 103*e* to form spectral light which can be seen by the naked eye E as a number of light beams with various coloring.

Figure 3B:
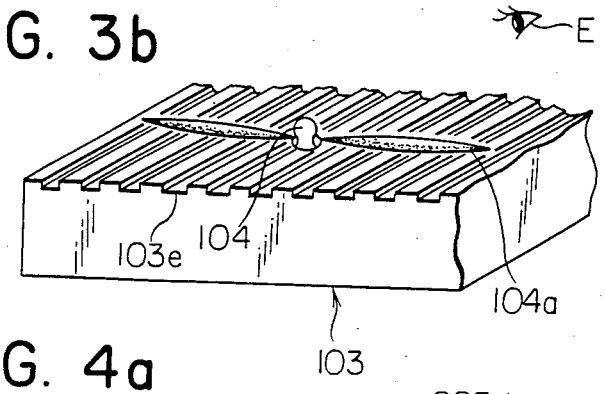

FIG. 3*b* shows a rectilinear spectral light 104*a* formed on the surface of the spectral resolution reflecting panel 103 having the reflecting diffraction grating 103*e* of the parallel striped pattern as illustrated in FIG. 3*a*. In this case, the spectral light 104*a* is formed by resolution of the light beams from the light sources 104 in a direction parallel to the stripes of the reflecting diffraction grating 103*e*.

Figure 4A:
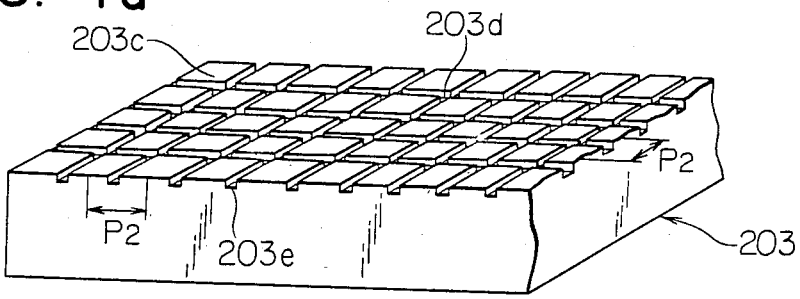
Figure 4B:
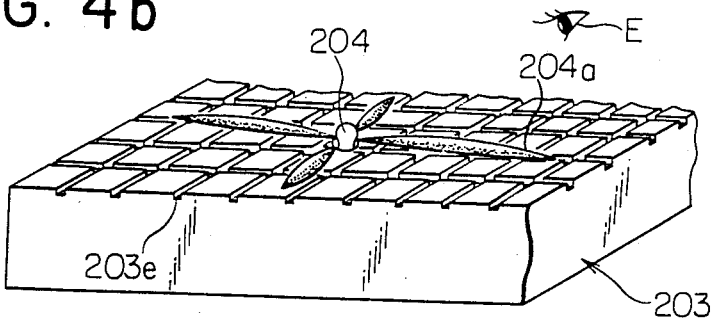

FIGS. 4*a* and 4*b* are views similar to FIGS. 3*a* and 3*b*, respectively. FIG. 4*a* shows another spectral resolution reflecting panel 203 provided on its one surface with a reflecting diffraction grating 203*e* in the form of a cross striped pattern. In this case, spectral light 204*a* in the form of a cross with a white point light source 204 at its center is formed on the surface with the cross striped grating 203*e* of the spectral resolution reflecting panel 203. Here, it is to be noted that the pattern of the spectral light can be varied in accordance with a change in the pattern of the reflecting diffraction grating 203*e*.

Figure 4C:
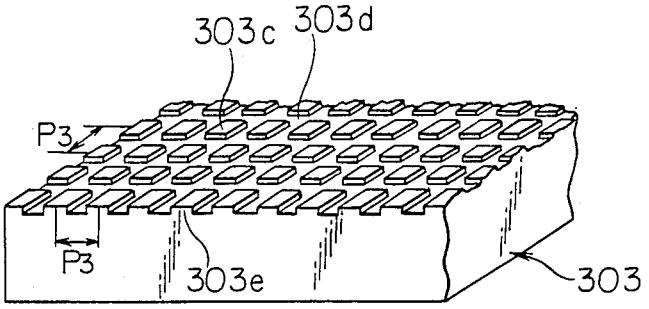
Figure 4D:
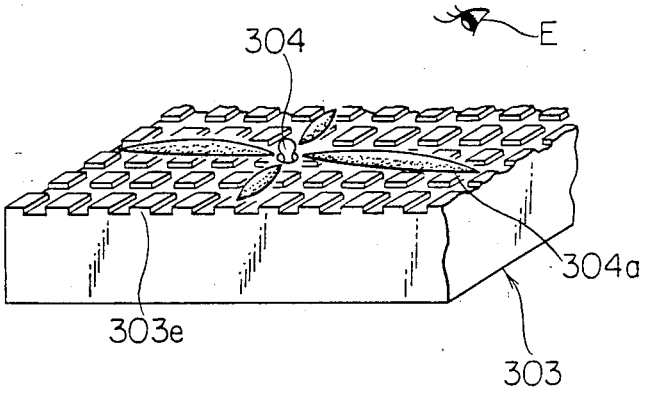

FIGS. 4*c* and 4*d* are views similar to FIGS. 3*a* and 3*b*, respectively. FIG. 4*c* shows a part of a spectral resolution reflecting panel 303 having a reflecting diffraction grating 303*e* of a waffled pattern which is composed of convex stainless mirror surfaces 303*c* and concave stainless mat or frosted surfaces 303*d* alternately arranged in the longitudinal and transverse directions at a pitch P3 substantially equal to the pitch P2 in FIG. 4*a*, the width of each of the concave stainless mat surfaces 303*d* being greater than that of each stainless mat surface 203*d* in FIG. 4*a* and equal to the width of each of the convex stainless mirror surfaces 303*c*.

In cases where the interior of the elevator car 101 is illuminated with the use of the spectral resolution reflecting panel 203 or 303 as illustrated in FIG. 4*a* or 4*c*, a part of the light from the light sources 204 or 304 is resolved by the spectral resolution reflecting panel 203 or 303 into the spectral light 204*a* or 304*a*, as illustrated in FIGS. 4*b* or 4*d*, which acts, in cooperation with the remaining portion of the light beams directly radiated from the light sources 204 or 304 into the car interior, to enhance the luminance, hue and attractiveness of the lighting in the interior of the car 101.

Further, in the event that the light sources are in the form of point light sources, the spectral light 104, 204 or 304 produced by the spectral resolution reflecting panel 103, 203 or 303 can be seen as enlarged by the width of each light source 104, 204 or 304 to have an elongated and wide lighting area, so that the luminance on the entire ceiling surface in the elevator car 101 is increased, thereby reducing the required number of light sources and hence the cost of production.

Figure 5:
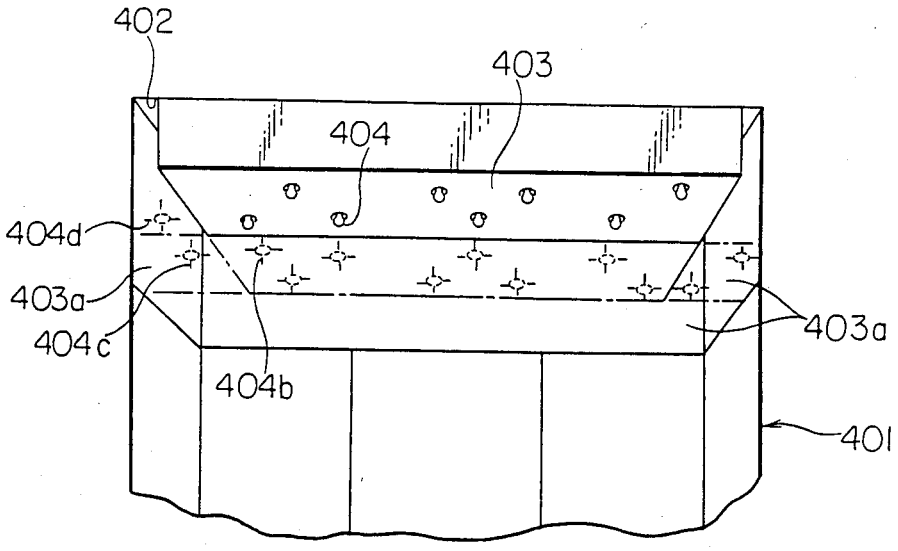
FIG. 5 is a perspective view showing an internal structure of an elevator equipped with a lighting device which is constructed in accordance with another embodiment of the present invention.

FIG. 5 shows another embodiment of the present invention. In this embodiment, in addition to a ceiling spectral resolution reflecting panel 403 mounted on the ceiling panel 402, side spectral resolution reflecting panels 403*a* are mounted on the upper portions of the side panels of the elevator car 401 with their mirror surfaces facing the car interior so that the light issuing from light sources 404, mounted on the ceiling spectral resolution reflecting panel 403 in a dispersed pattern, is received and spectrally resolved by the side spectral resolution reflecting panels 403*a* to form images 404*b*, 404*c* and 404*d* of light sources thereon, thus producing spectral light which can effectively widen or enlarge the area of illumination of the actual light sources 404. As a result, a very splendid lighting device is provided.

Figure 6:
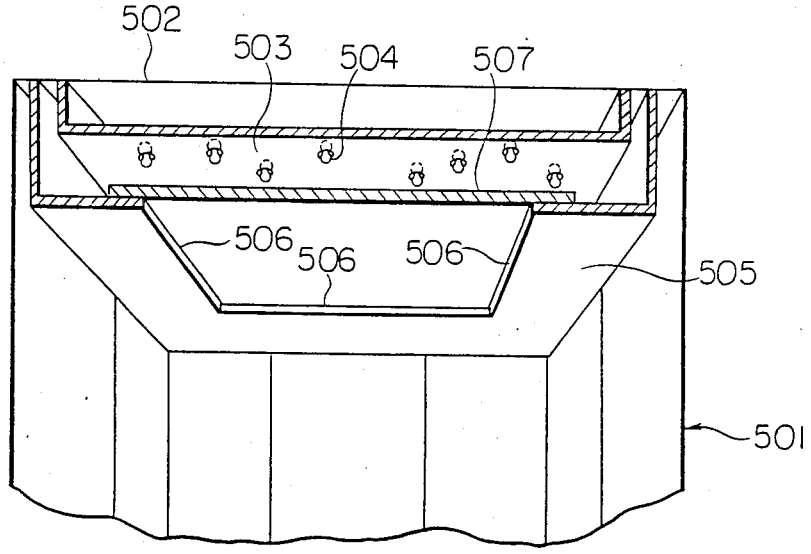
FIG. 6 is a perspective view showing an internal structure of an elevator equipped with a lighting device which is constructed in accordance with a further embodiment of the present invention.
Figure 7:
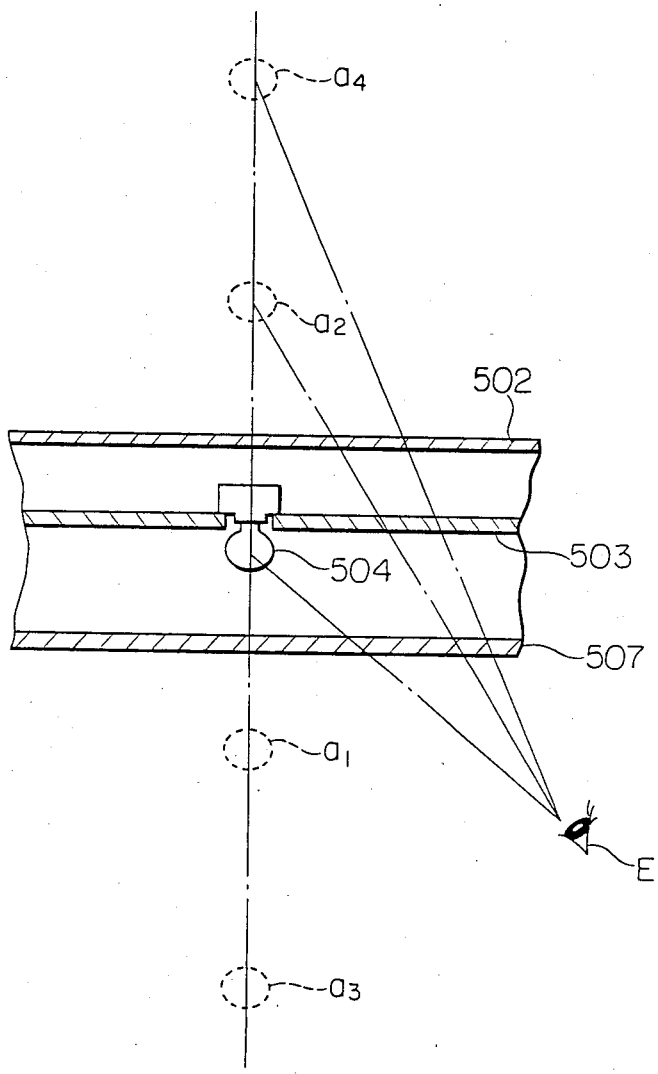
FIG. 7 is an enlarged cross sectional view showing the operation of the lighting device of FIG. 6.

FIG. 6 shows a further embodiment of the present invention. In this embodiment, a spectral resolution reflecting panel 503 having a plurality of light sources 504 is mounted on a ceiling panel 502 of an elevator car 501, and a decorative ceiling frame 505 having an opening 506 formed therethrough is also mounted on the ceiling panel 502 so as to enclose the spectral resolution reflecting panel 503. A half mirror filter 507 is attached to the opening 506 in the decorative ceiling frame 505 so that the passengers in the elevator car 501 can see the light sources 504 through the half mirror filter 507. With this arrangement, the light emitted from the light sources 504 is reflected by the spectral resolution reflecting panel 503 and the half mirror filter 507 to produce a number of imaginary light sources, as a consequence of which a splendid lighting device is provided which has a number of imaginary light sources visually covering a wide area with varying lighting effects. Specifically, as illustrated in FIG. 7, the light from the light source 504 such as an electric lamp can be directly see through the half mirror filter 507 by the eyes E of a passenger in the elevator car.

On the other hand, a virtual image al of the light source 504 resulting from the half mirror filter 507 creates, under the action of the spectral resolution reflecting panel 503, another virtual image a2 accompanying spectral light which in turn produces a further virtual image a3 by means of the half mirror filter 507, the virtual image a3 producing a still further virtual image a4 accompanying spectral light through the action of the spectral resolution reflecting panel 503. In this manner, there are formed an infinite number of virtual images of the light sources 504 which can be seen by the eyes E of a passenger in an elevator car.

Although in the above-described embodiments, the lighting device is installed at the ceiling of a car, it may be provided on some other places in the car such as, for example, on the side walls of the car. In such cases, the same illumination effects will be obtained as in the foregoing embodiments.

Now, a process for making the above-described spectral resolution reflecting panel in the form of a mirror decorative panel formed of metal will be described in detail with reference to FIGS. 8 through 14.

Figure 8:
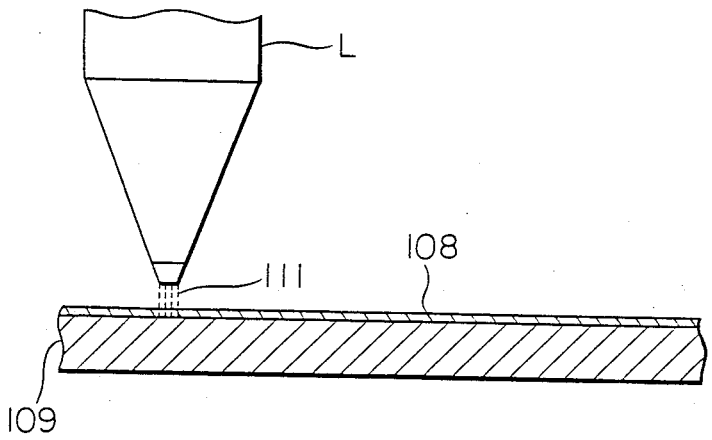
FIGS. 8 through 13 are cross sectional views showing a process of making a spectral resolution reflecting panel of the present invention.
Figure 9:
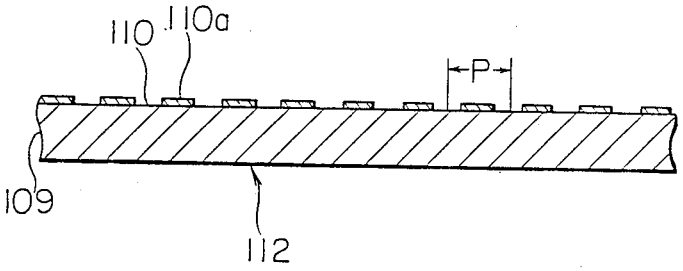

As shown in FIG. 8, a transparent film 109 having a photosensitive thin layer 108 formed on its surface is irradiated with laser beams 111 from a laser oscillator L so that as pictured in FIG. 9, those portions of the photosensitive thin layer 108 on the transparent film 109 which are subjected to the laser irradiation are removed to expose the surface or transparent stripes 10 of the transparent film 109 while the portions of the photosensitive thin layer 108 not irradiated with the laser beams remain intact, covering the surface of the transparent film 109 so as to form light-shielding stripes 110*a*. Thus, a light-transmitting film 112 is provided which has the transparent stripes 110 and the light-shielding stripes 110*a* alternately arranged in parallel with each other at a pitch P ranging from a few microns to several tens of microns.

Figure 10:
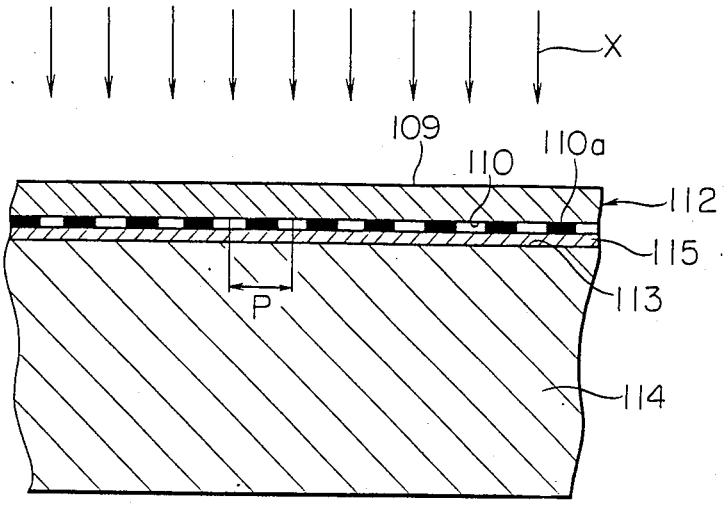
Figure 11:
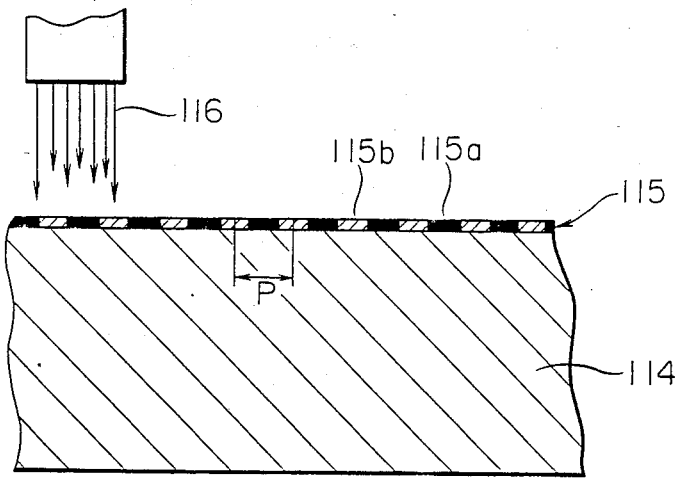

Subsequently, as illustrated in FIG. 10, a film-masking layer 115 is formed on a mirror surface 113 of a metal mirror plate 114, the mirror surface being formed by polishing, and the light-transmitting film 112 produced in the above manner is superposed on the metal mirror plate 114 with the light-shielding layer 110*a* being in contact with the film-masking layer 115. Then, when photosensitive rays X are irradiated on the entire surface of the light-transmitting film 112 from the transparent film 109 side, a part of them passes through the transparent stripes 110 alone and enter the film-masking layer 115. As a result, only those portions of the film-masking layer 115 which are subjected to the irradiation of the photosensitive rays X are sensitized to provide cured photosensitive layers 115*a*, whereas the remaining part of the photosensitive rays X passing through the light-transmitting film 112 are interrupted by the light-shielding stripes 110*a* and prevented from entering the film-masking layer 115 so that those portions of the film-masking layer 115 which are blocked from the passage of the photosensitive rays X are not sensitized to form a non-cured photosensitive layer 115*b*.

In this manner, the above-described film-masking layer 115 is changed into a metal-masking photosensitive layer which is comprised of the sensitized and cured photosensitive stripes 115*a* and the non-sensitized and non-cured photosensitive stripes 115*b* arranged in an alternate relation with each other. Thereafter, only the non-cured photosensitive stripes 115*b* of the metal-masking photosensitive layer 115 are chemically removed by means of a photosensitive-film remover 116, so that the sensitized and cured stripes 115*a* are left, thus forming a metal masking 115' in the form of a parallel stipe pattern.

Figure 12:
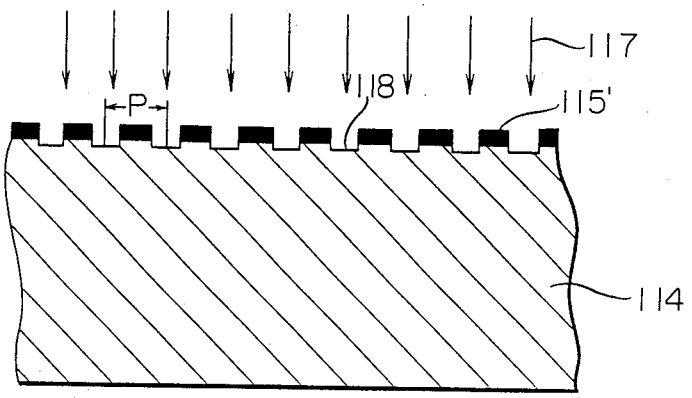
Figure 13:
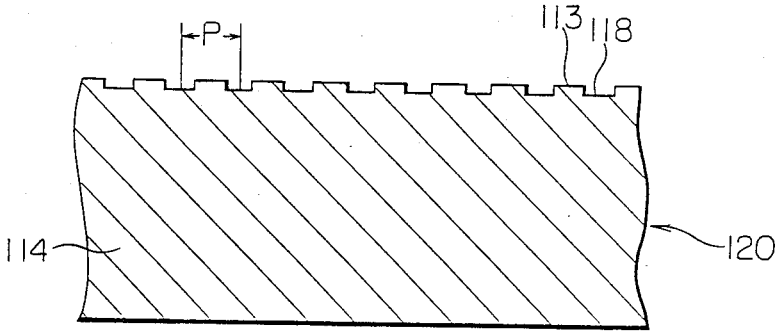

Subsequently, as shown in FIG. 12, the metal mirror plate 114 having the metal masking 115' thus formed is subjected to etching by the use of a metal etching agent, and only the exposed surface portions of the metal mirror plate 114 from which the metal-masking photosensitive layer 115' is removed is etched to form a number of etched mat or frosted surfaces 118. After completion of the etching, as shown in FIG. 13, the metal masking 115' is removed to expose the original metal mirror surface 113 in the form of parallel stripes creating a parallel stripe pattern which includes the exposed metal mirror surface stripes 113 and the etched mat or frosted surface stripes 118 alternately arranged in a parallel relation with each other at a pitch P completely corresponding to the pitch in the range of from a few microns to several tens of microns originally defined by the laser beams 111.

Figure 14:
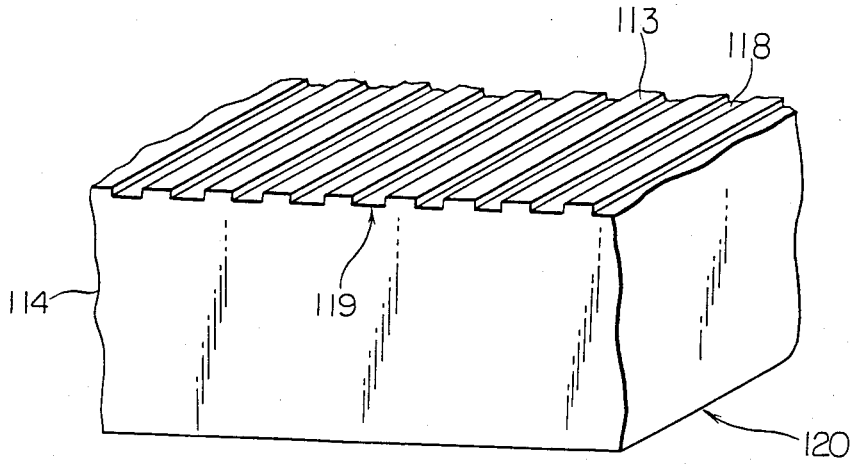
FIG. 14 is a perspective view showing a part of the spectral resolution reflecting panel of FIG. 13.

Thus, as perspectively illustrated in FIG. 14, a metal mirror decorative panel 120 is finally provided which has a reflecting diffraction grating 119 of a fine parallel stripe pattern formed on the upper surface of the metal mirror plate 114, the parallel stripe pattern being composed of the metal mirror fine surface stripes 113 and the etched mat or frosted fine surface stripes 118 alternately disposed in parallel with each other at a pitch P. The metal mirror decorative panel 120 constructed in this manner can be used in such a way as illustrated in FIGS. 3*a* and 3*b*.

Figure 15:
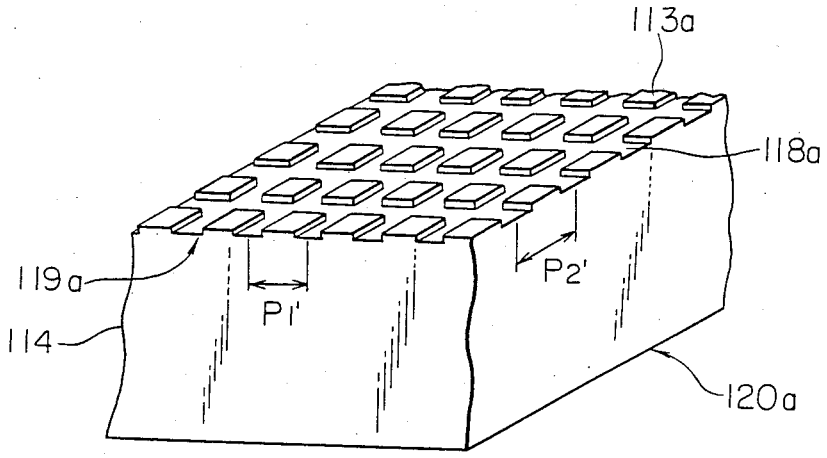
FIG. 15 is a perspective view showing a part of another spectral resolution reflecting panel made by the process of the present invention.
Figure 16:
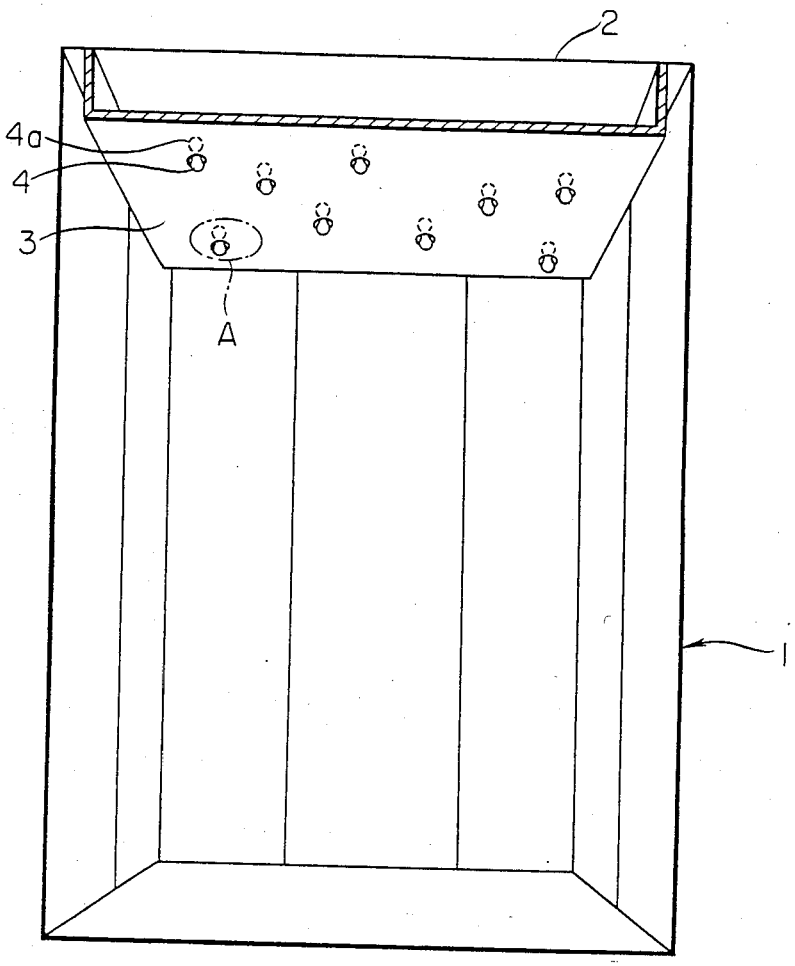
FIG. 16 PRIOR ART
FIG. 16 is a perspective view showing an internal structure of an elevator equipped with a conventional lighting device.
Figure 17:
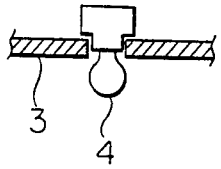
FIG. 17 PRIOR ART
FIG. 17 is a detailed cross sectional view showing, on an enlarged scale, a part of the lighting device of FIG. 16 encircled by the dashed line A.

Although in the above-mentioned production process shown in FIGS. 8 through 14, the reflecting diffraction grating 119 in the form of a parallel stripe pattern is produced, a different reflecting diffraction grating such as shown in FIG. 15 can also be made in accordance with a similar process. For example, as depicted in FIG. 15, a metal mirror decorative panel 120*a* can be produced which has a reflecting diffraction grating 119*a* of a fine cross-striped pattern on the upper surface of the metal mirror plate 114, the cross-striped pattern being composed of square-shaped of rectangular-shaped metal mirror surface portions 113*a* and etched mat or frosted surface portions 118*a* alternately arranged in one direction at a pitch P1' and in the direction normal to the first-mentioned direction at a pitch P2'. The metal mirror decorative panel 120*a* thus produced can be used in such a way as shown in FIGS. 4*a* and 4*b*. Similar to the parallel striped pattern of the previously described metal mirror decorative panel 120, the pitches P1' and P2' of the cross-striped pattern of the decorative panel 120*a* are in the range from a few microns to several tens of microns, for example. Though in FIG. 15, the metal mirror surface portions 113*a* are of square or rectangular shapes and the etched mat surface portions 118*a* are of cross-striped groove shapes, this relationship may be reversed, that is the etched mat surface portions can be of square or rectangular shapes and the metal mirror surface portions of cross-striped groove shapes.

Accordingly, by the use of the process as shown in FIGS. 8 through 15, a multitude of metal mirror decorative panels can be manufactured in quantity at low cost.

In place of a metal mirror decorative panel as conventionally used, a metal mirror decorative panel can be employed for the lighting of an elevator car which is made of the metal mirror plate 114 having its surface applied by a spectral resolution reflection working as specifically described in the foregoing. In this case, when the interior space in an elevator car is illuminated by white point light sources as pictured in FIGS. 3*b* or 4*b*, a portion of the light from the light sources is spectrally resolved by the metal mirror decorative panel into rainbow-colored spectral light of good saturation which is added to the light directly emitted from the light sources into the car interior so as to materially improve the luminance, hue and attractiveness of the interior illumination of the car.

Further, where the light sources are in the form of point light sources such as electric lamps, spectral light created by the metal mirror decorative panel of the present invention can be seen as having an elongated and wide area enlarged by the width of each point light source, thereby increasing the light intensity of the light sources. As a result, even a relatively small number of light sources can provide a good decorative effect, or for attaining an ordinary level of illumination, it is possible to reduce the number of light sources and hence markedly minimize the cost of production.

Moreover, the metal mirror decorative panel of the invention may be formed of materials other than stainless steel such as, for example, brass, red brass, chrome-plated metal, aluminum, copper and glass in order to increase design variables.

As will be apparent from the foregoing description, the lighting device of the present invention includes a plurality of light sources and a reflection panel in the form of a spectral resolution reflecting panel. With this construction, light emitted from the light sources is spectrally resolved into spectral light of various coloring by the reflection panel so that the luminance and hue in the illumination of the car interior are greatly improved, thus increasing the light intensity on the entire ceiling surface and hence in the interior of the elevator car.

What is claimed is:

1. A lighting device for an elevator car having walls comprising: a plurality of light sources for emitting light; and a reflection panel mounted on a wall of the elevator car and having a reflecting surface to reflect the light from said light sources toward the interior of the elevator car; said light sources being mounted on said reflection panel and said reflection panel reflecting surface comprising a spectral resolution reflecting diffraction grating which acts to spectrally resolve the light from said light sources into spectral light.

2. A lighting device for an elevator as claimed in claim 1 wherein said reflection panel is arranged on ceiling and side walls of said elevator car.

3. A lighting device for an elevator as claimed in claim 1 wherein the reflecting surface of said reflection panel is composed of a plurality of mirror reflection surfaces comprising a reflecting diffraction grating, each of a small area, and a plurality of frosted surfaces, each of a small area, said mirror reflection surfaces and said frosted surfaces being arranged in a predetermined pattern.

4. A lighting device for an elevator as claimed in claim 3 wherein the mirror reflection surfaces of said reflection panel are raised from the frosted surfaces of said reflection panel.

5. A lighting device for an elevator as claimed in claim 3 wherein the mirror reflection surfaces and the frosted surfaces of said reflection panel are alternately arranged at a pitch ranging from a few microns to several tens of microns.

6. A lighting device for an elevator as claimed in claim 1 wherein the reflecting surface of said reflection panel comprises a reflecting diffraction grating having a multitude of fine linear mirror reflection surfaces and a multitude if fine areal frosted surfaces alternately arranged with each other.

7. A lighting device for an elevator as claimed in claim 1 wherein the reflecting surface of said reflection panel comprises a reflecting diffraction grating having a multitude of small mirror reflection surfaces disposed at a predetermined interval in a dispersed manner, and a multitude of frosted surfaces respectively disposed between the adjacent ones of said mirror reflection surfaces.

8. A lighting device for an elevator car having walls comprising: a plurality of light sources for emitting light; and a reflection panel mounted on a ceiling wall of the elevator car and having a reflecting surface and a plurality of apertures formed therethrough, said reflecting surface comprising a spectral resolution reflecting panel having a reflecting diffraction grating which acts to spectrally resolve the light from said light sources into spectral light, said light sources being mounted on said reflection panel in a manner such that said light sources project through said apertures toward the interior of the car and spectral light from said sources is reflected toward the interior of the car.

9. A lighting device for an elevator car having walls comprising: a plurality of light sources for emitting light; a reflection panel mounted on a ceiling wall of said elevator car and having a reflecting surface comprising a spectral resolution reflecting diffraction grating which acts to spectrally resolve the light from said light sources into spectral light; and a half mirror filter disposed downwardly away from said reflection panel and having a mirror surface formed on one side in face-to-face relation with said reflection panel so that the light from said light sources is reflected between and by said reflection panel and said half mirror filter.

* * * * *